US007287574B2

(12) United States Patent
Desai et al.

(10) Patent No.: US 7,287,574 B2
(45) Date of Patent: Oct. 30, 2007

(54) ATTACHMENT AND ARTICLES USING SAME

(75) Inventors: Sameer Desai, Lake Orion, MI (US); Daniel R. Domen, Rochester Hills, MI (US); Norman Woodworth, Lake Orion, MI (US)

(73) Assignee: Valeo, Inc., Auburn Hills, MI (US)

( * ) Notice: Subject to any disclaimer, the term of this patent is extended or adjusted under 35 U.S.C. 154(b) by 585 days.

(21) Appl. No.: 10/502,813

(22) PCT Filed: Feb. 10, 2003

(86) PCT No.: PCT/US03/03985

§ 371 (c)(1),
(2), (4) Date: Jul. 26, 2004

(87) PCT Pub. No.: WO03/069251

PCT Pub. Date: Aug. 21, 2003

(65) Prior Publication Data

US 2004/0259236 A1 Dec. 23, 2004

(51) Int. Cl.
*F28F 9/00* (2006.01)

(52) U.S. Cl. ..... 165/67; 165/140; 165/916; 180/68.4

(58) Field of Classification Search ..... 165/67, 165/140, 916; 180/68.4
See application file for complete search history.

(56) References Cited

U.S. PATENT DOCUMENTS

| | | | | |
|---|---|---|---|---|
| 3,938,587 | A * | 2/1976 | Vian | 165/76 |
| 5,628,096 | A * | 5/1997 | Watters et al. | 24/590.1 |
| 5,657,817 | A * | 8/1997 | Heine et al. | 165/67 |
| 5,996,684 | A * | 12/1999 | Clifton et al. | 165/67 |
| 6,158,500 | A * | 12/2000 | Heine | 165/67 |
| 6,315,034 | B1 * | 11/2001 | Mahe et al. | 165/121 |
| 7,059,392 | B2 * | 6/2006 | Kovac | 165/140 |
| 2002/0157812 | A1 * | 10/2002 | Anderson et al. | 165/67 |
| 2005/0006071 | A1 * | 1/2005 | Kovac | 165/140 |
| 2007/0089855 | A1 * | 4/2007 | Heine | 165/67 |
| 2007/0119564 | A1 * | 5/2007 | Contet | 165/67 |

* cited by examiner

*Primary Examiner*—Allen J. Flanigan

(57) ABSTRACT

There is disclosed an attachment (12) suitable for attaching a first component of an article to a second component of the article. The attachment preferably includes a flange portion (20) extending from the first component and one, but preferably, a pair of flange members (22) extending from the second component. The flange portion (12) and the flange members (22) typically interferingly engage one another for attaching the first component to the second component. It has been found that the attachment provided in the present invention is particularly effective for attaching a heat exchanger (14) to another component such as a shroud or another heat exchanger (16) together for forming a heat exchanger assembly (10).

9 Claims, 6 Drawing Sheets

ATTACHMENT AND ARTICLES USING SAME

FIELD OF THE INVENTION

The present invention relates generally to an attachment for attaching a first component to a second component. More particularly, the present invention relates to an attachment for attaching at least one heater exchanger to a component such as a shroud or another heat exchanger for forming a heat exchanger assembly.

BACKGROUND OF THE INVENTION

For many years, industry has been concerned with designing improved attachments for various articles and applications. As an example, industry has designed attachments suitable for attaching a heat exchanger to a component such as a shroud, a wall, another heat exchanger, a front end structure of an automotive vehicle or the like to form a heat exchanger assembly, which may be employed in articles of manufacture such as automotive vehicles. In the interest of continuing such innovation, the present invention provides an attachment, which may be suitable for various applications, but which has found particular utility in heat exchanger assemblies that may be integrated into automotive vehicles or other articles.

SUMMARY OF THE INVENTION

According to one aspect of the invention, there is disclosed an attachment for attaching a first component of an article to a second component of the article. As an example, the attachment may be employed for attaching a first heat exchanger to a component such as a shroud, a wall, another heat exchanger, a front end structure or module of an automotive vehicle or the like for assisting in forming a heat exchanger assembly. According to one embodiment, the attachment includes a pair of flexible flange members, which are preferably arranged in spaced apart opposing relation to each other and which also preferably extend from the second component. The attachment also includes a flange portion, which typically extends from the first component. Preferably, the flange portion includes a pair of flanges extending therefrom although not required. The flanges of the flange portion are typically received in openings of the pair of flange members for securing the flange portion to the flange members, however, the flange portion may be otherwise secured to the flange members as well. Optionally, the flange portion includes an opening for receiving a protrusion of the attachment thereby assisting in securing the components relative to each other.

BRIEF DESCRIPTION OF THE DRAWINGS

The features and inventive aspects of the present invention will become more apparent upon reading the following detailed description, claims and drawings, of which the following is a brief description:

DETAILED DESCRIPTION OF THE INVENTION

The present invention is predicated upon providing an improved attachment. It is contemplated that the attachment may be employed in a variety of articles of manufacture including, without limitation, electronic articles, buildings, furniture, recreational articles, manufacturing articles or the like. The attachment, however, is particularly suitable for use in heat exchanger assemblies and even more particularly, the attachment is suitable for use in heat exchanger assemblies of automotive vehicles. Thus for convenience, the illustrated attachments are applied to heat exchanger assemblies, however, the skilled artisan will appreciate that the assemblies may be adapted for use in other articles as well.

As used herein the term "heat exchanger" is intended to include any system configured for exchanging heat to or from one or more fluids that are preferably flowing within or about the system. Thus, a heat exchanger may be an oil cooler, a water cooler, an air heater, a condenser, a fan shroud, a radiator, a front end structure to carry engine cooling components or the like.

Figure 1A:
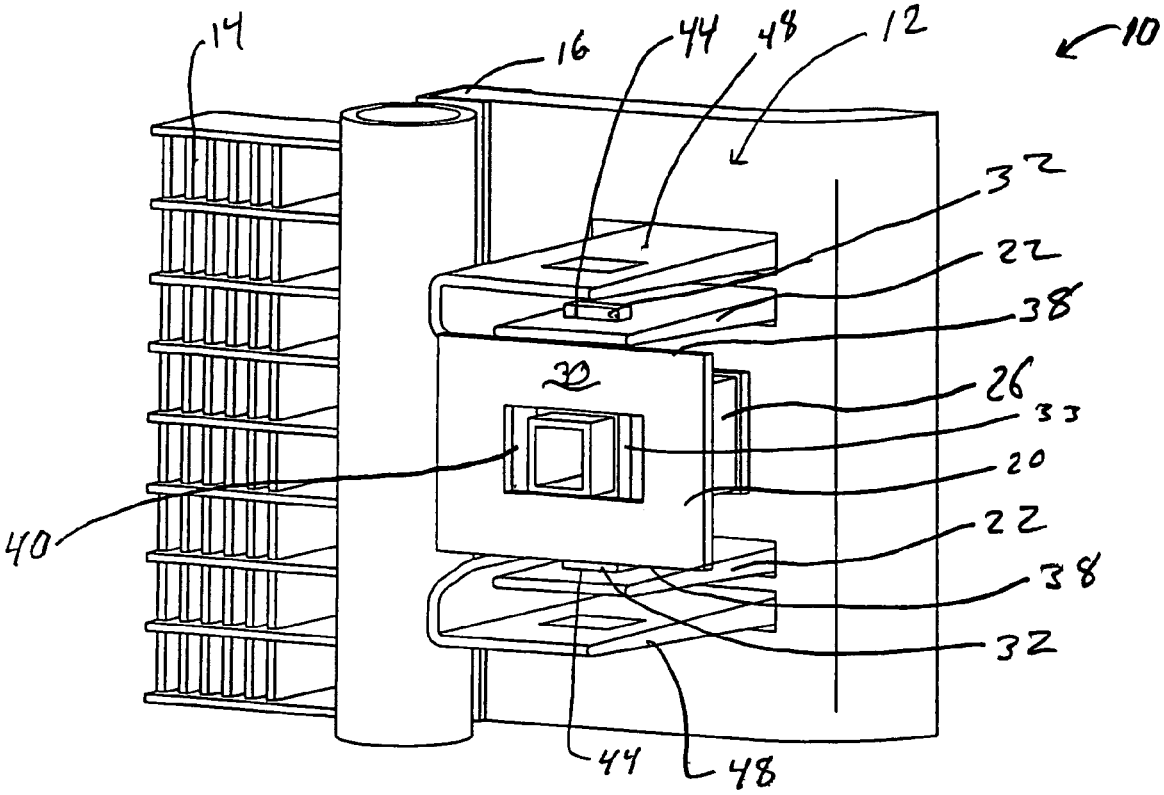
FIG. 1A is a perspective view of a heat exchanger assembly employing an attachment in accordance with an exemplary aspect of the present invention.
Figure 1B:
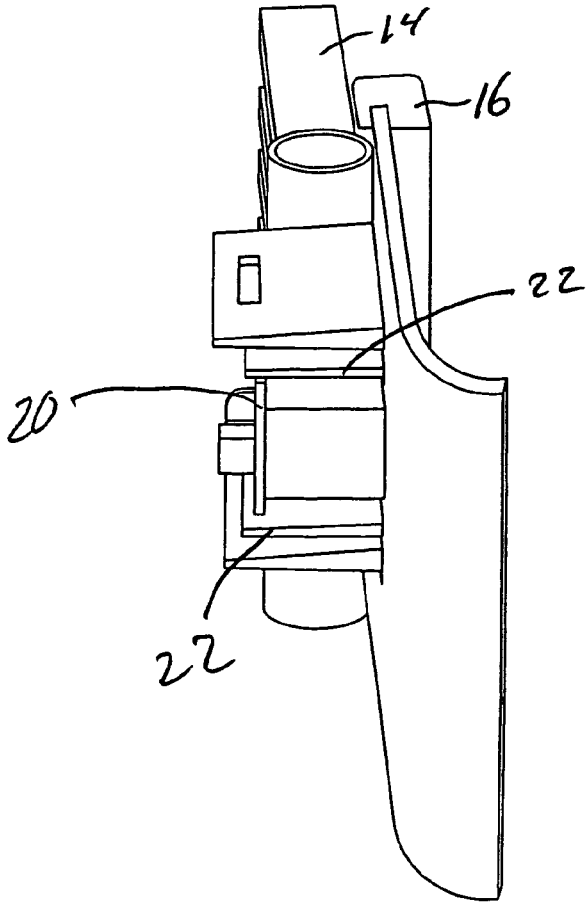
FIG. 1B is another perspective view of the heat exchanger assembly of FIG. 1A.

Referring to FIGS. 1A and 1B, there is illustrated an assembly, which is shown as a heat exchanger assembly 10, but which could be a variety of articles of manufacture. The heat exchanger assembly 10 includes an attachment 12 for attaching a first component shown as a first heat exchanger 14 to a second component shown as a second heat exchanger 16. The skilled artisan shall appreciate, however, that a variety of components of various articles of manufacture may be attached with the attachment described herein.

The attachment 12 includes a flanged portion 20 and one or more flexible flange members 22. As shown, the flange portion 20 is connected to and preferably extends from the first heat exchanger 14. Alternatively, the flange portion may extend from other portions of the attachment 12, the heat exchangers 14, 16 or other structures. The flexible flange members 22 are connected to and extend outwardly from the second heat exchanger 16. As with the flanged portion 20, however, it is contemplated that the flange members 22 may extend from other portions of the attachment 12, the heat exchangers 14, 16 or other structures. Optionally, a protrusion 26 may be connected to either the first or second heat exchanger 14, 16, but preferably the second heat exchanger 16. As shown, the protrusion 26 extends outwardly from the second heat exchanger 16.

The flanged portion 20 preferably includes a central portion and at least one flange extending outwardly from the central portion. It is contemplated that the flanged portion and it flanges may be configured to have a variety of shapes and sizes. In the embodiment shown, the flanged portion 20 includes a central rectangular portion 30 with a pair of flanges 32 extending outward from opposite sides 38 of the central portion 30. The flanged portion 20 also optionally includes an opening 40 centrally located in the central portion 30.

The one or more flexible flange members 22 preferably include at least two flange members 22, but may include only one or more than two. The flange members 22 may be formed in a variety of shapes, sizes and configuration. In FIGS. 1A and 1B, the flange members 22 are rectangular and each includes an opening 44 (e.g., a through-hole), which preferably extends through its respective member 22. As shown, the flange members 22 are separate and spaced apart from each other and are in opposing relation to each other. It is contemplated, however, that the flange members 22 may be alternatively positioned relative to each other such as perpendicular to each other or otherwise positioned.

Optionally, one or more protectors 48 may also be provided. Each protector 48 is typically adjacent one of the flange members 22 and preferably extends from the second heat exchanger 16. In FIGS. 1A and 1B, there are a pair of rectangular protectors 48 and each protector 48 is in spaced apart opposing relation to its respective flange member 22. Preferably, each protector 48 is substantially coextensive with its respective flange member 22. The protectors 48 can also be positioned to limit the flexing of flanges 22 within the intended design limits.

The flanged portion 20, the flexible flange members 22, the protrusion 26 and the protective members 48 may be formed of several materials including plastics, metals (e.g., steel, iron, aluminum, magnesium) or the like depending upon the desired characteristic of these components and depending upon the articles to which the components are attached. Exemplary metals include steel, iron, aluminum, copper, brass, magnesium or combinations thereof. Moreover, the flanged portion 20, the flexible flange members 22, the protrusion 26 and the protective members 48 may be integrally formed (e.g., cast, molded or otherwise shape) with the heat exchangers 14, 16 or may be connected (e.g., adhered, fastened or the like) to the heat exchangers 14, 16 as separate parts.

In the preferred embodiment illustrated, the flanged portion 20 is a portion of a part such as a bracket that is attached to the first heat exchanger 14. The flexible flange members 22, the protrusion 26 and the protective members 48 are illustrated as plastic parts attached to the second heat exchanger 16.

The one or more flanges 32 of the flange portion 20 are received in the respective openings 44 of the one or more flexible flange members 22 thereby affixing or attaching the first heat exchanger 14 to the second heat exchanger 16. The flanges 32 are preferably received in the openings 44 by temporarily flexing or bending the flange members 22 away from an original position (e.g., away from each other). At the same time or thereafter, the flanges 32 are moved relative to the flange members 22 (e.g., by moving the flanged portion 20 to a location between the flange members 22) such that the flange members 22, upon return to or toward their original position, receive the flanges within their openings 44.

Preferably, when provided, the protrusion 26 is received in the opening 40 of the flanged portion 20 as the first heat exchanger 14 is affixed to the second heat exchanger 16. Advantageously, the protective members 48 can protect the flanges 32 from becoming dislodged from the openings 44 of the flange members 22. Also advantageous, however, the flanges 32 may be manually or mechanically released by outwardly flexing the flange members 22 particularly in one of the heat exchangers 14, 16 or other components need servicing.

In the embodiment of FIGS. 1A and 1B, the flanged portion 20 may be secured relative to the flange members 22 to limit or substantially restrict relative motion therebetween in one, two or three dimensions. In the embodiment shown, the flanges 32 are secured within the openings 44 of the flange members 22 such that the flanges 32 and a platform 33 of the protrusion 26 maintain the flanged portion 20 within tight tolerances (e.g., less than one or two millimeters) along a first axis (e.g., a horizontal axis). In this manner, movement is substantially entirely prohibited in directions along the first axis. Additionally, the protrusion 26 is preferably secured within the opening 46 of the flanged portion 20 within tight tolerances along a second axis (e.g., a vertical axis) wherein the second axis is skew or substantially perpendicular to the first axis. In this manner, movement is substantially entirely prohibited in directions along the third axis. Thus, once attached, movement of the flanged portion 20 relative to the flange members 22 is substantially entirely restricted in at least two dimensions.

Of course, it is contemplated that attachments according to the present invention may allow motion as well as restrict motion. Moreover, various larger or smaller tolerances may be formed between openings, flanges, flanged portions, flange members, protrusions or any other components to restrict or allow motion as desired.

As an alternative to the embodiment of FIGS. 1A and 1B, it is contemplated that the flanged portion may include more than one opening and the flanges may extend toward each other, optionally, into one of the openings. In such an embodiment, the flange members typically extend into one of the openings of the flanged portion such that the flanges may be interference fit within openings of the flange members. Moreover, in such an embodiment, the protrusion preferably extends into the other opening as previously described. It is also contemplated that attachments according to the present invention can include back-up fasteners such as screws that attach the flanged portion, the flanged members, the components or any combination thereof together for added strength of attachment. Preferably, such back-up fasteners are removeable to promote serviceability.

Figure 2A:
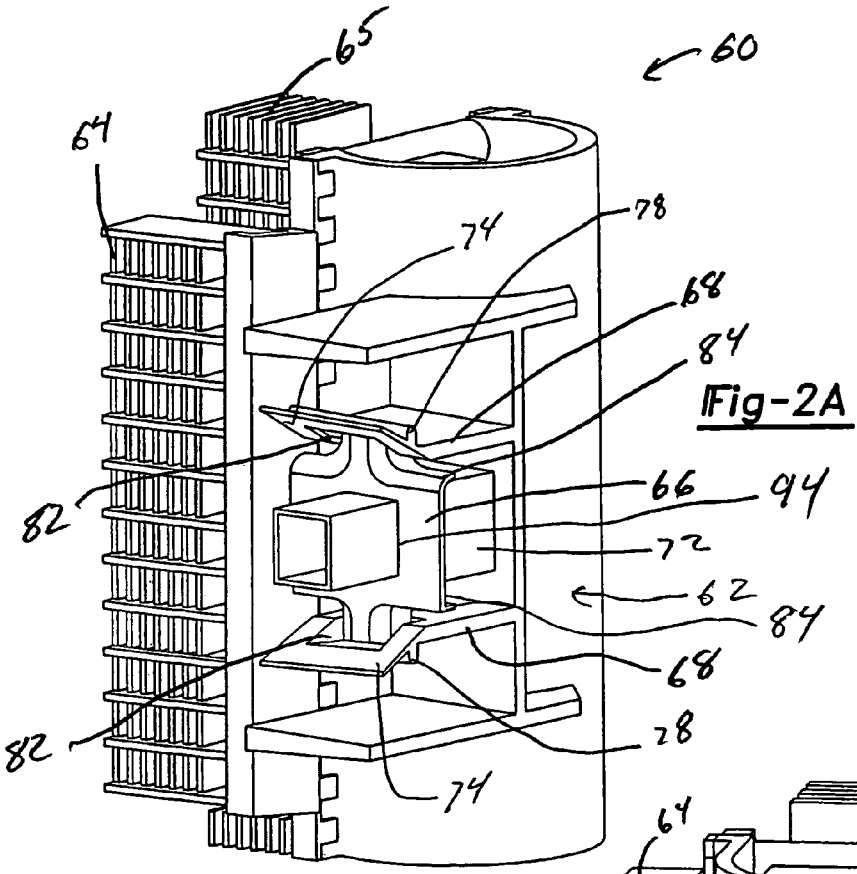
FIG. 2A is a perspective view of a heat exchanger assembly employing an alternative attachment in accordance with an exemplary aspect of the present invention.
Figure 2B:
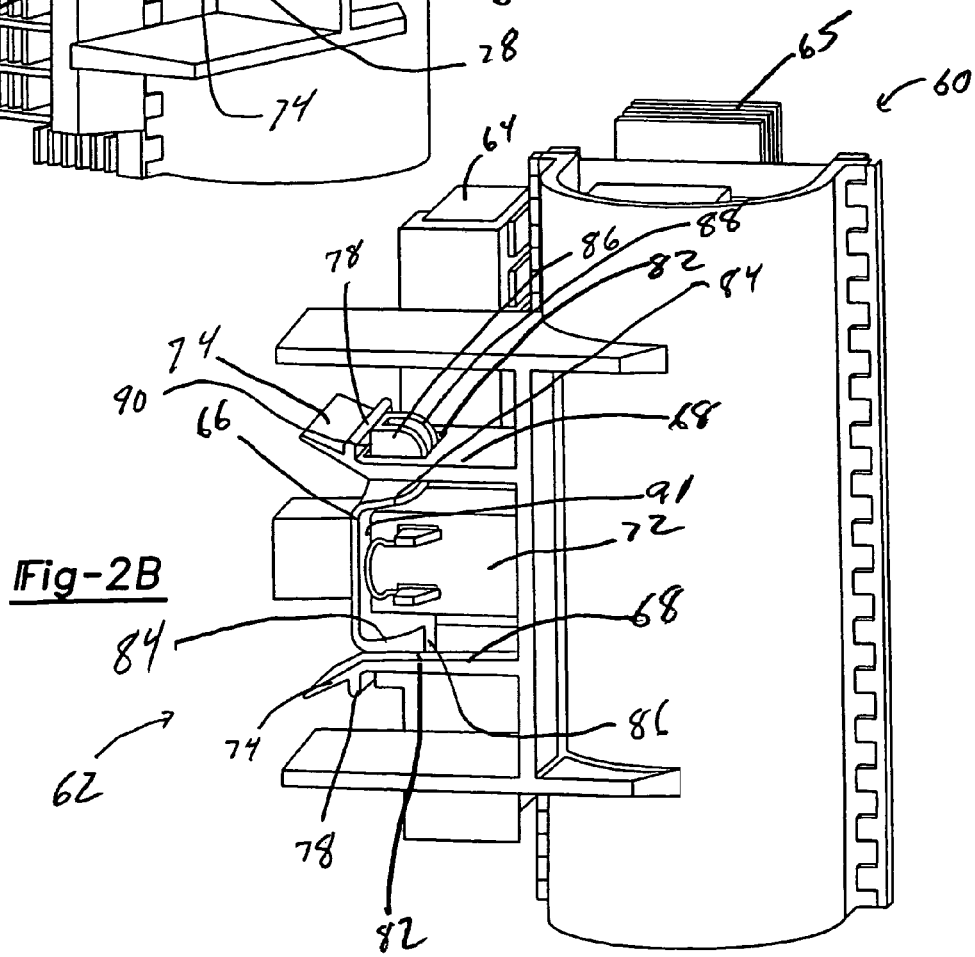
FIG. 2B is another perspective view of the heat exchanger assembly of FIG. 2A.

Referring to FIGS. 2A and 2B, there is illustrated another exemplary heat exchanger assembly 60 with an exemplary attachment 62 for attaching heat exchangers 64, 65 substantially similar to the attachment 12 shown in FIGS. 1A and 1B. The following discussion will focus upon the differences between the attachments. As shown, the attachment 62 includes a flanged portion 66, a pair of flange members 68 and a protrusion 72.

The flange members 68 each include a flared portion 74 that extends at least partially outwardly away from the opposite flange member 68. Each of the flange members 68 also includes a ridge 78 extending from the flared portion 74 of the flange members 68 adjacent an opening 82 of the flange members 68. The flanged portion 66 includes a pair of opposing extensions 84 extending from opposing sides of the flanged portion 66. Preferably, the extensions 84 support flanges 86 having a contoured portion 88 (e.g., a curved or angled surface or edge).

Upon attachment of the flanged portion 66 to the flexible flange members 68, the flanges 86 are received within the openings 82 of the flexible flange members 68 in the same manner as described for the attachment 12 of FIGS. 1A and 1B. As an added attachment advantage, however, the contoured surfaces 88 of the flanges 86 may be pressed against the flared portions 74 of the flange members 68 for assisting in flexing the flange members 74 away from their original positions (e.g., outwardly from each other). In turn, the flanges 68 may be more easily received in the openings 82 of the flange members 74. Also advantageous, the ridge 78 of the flange members 74 abuts a back side 90 of the flanges 86 for assisting in securing the flange portion 66 to the flexible flange members 74.

In the embodiment of FIGS. 2A and 2B, the flanged portion 66 may be secured relative to the flange members 68 to limit or substantially restrict relative motion therebetween in one, two or three dimensions. In the embodiment shown, the flanges 86 are secured within the openings 82 of the flange members 68 such that the flanges 86 and a platform 91 of the protrusion 72 maintain the flanged portion 20 within tight tolerances (e.g., less than one or two millimeters) along a first axis (e.g., a horizontal axis). Moreover, the protrusion 72 is received within an opening 94 of the flanged portion 66 within tight tolerances (e.g., less than one or two millimeters) along a second and third axis (e.g., a vertical axis and a horizontal axis) wherein the second and third axes are skew or perpendicular to each other and the first axis. In this manner, movement is substantially entirely prohibited in directions along the first, second and third axes. Thus, once attached, movement of the flanged portion 66 relative to the flange members 68 is substantially entirely restricted in three dimensions.

Of course, it is contemplated that attachments according to the present invention may allow motion as well as restrict motion. Moreover, various larger or smaller tolerances may be formed between openings, flanges, flanged portions, flange members, protrusions or any other components to restrict or allow motion as desired.

Figure 3A:
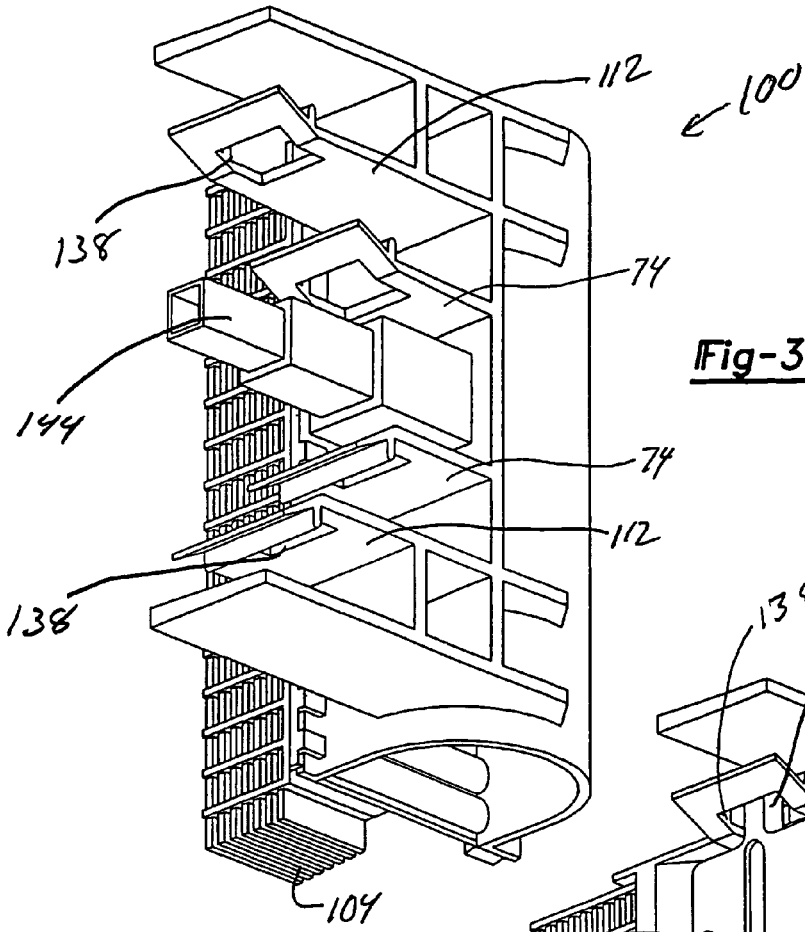
FIG. 3A is a perspective view of a portion of a heat exchanger assembly employing a portion of another alternative attachment in accordance with an exemplary aspect of the present invention.
Figure 3B:
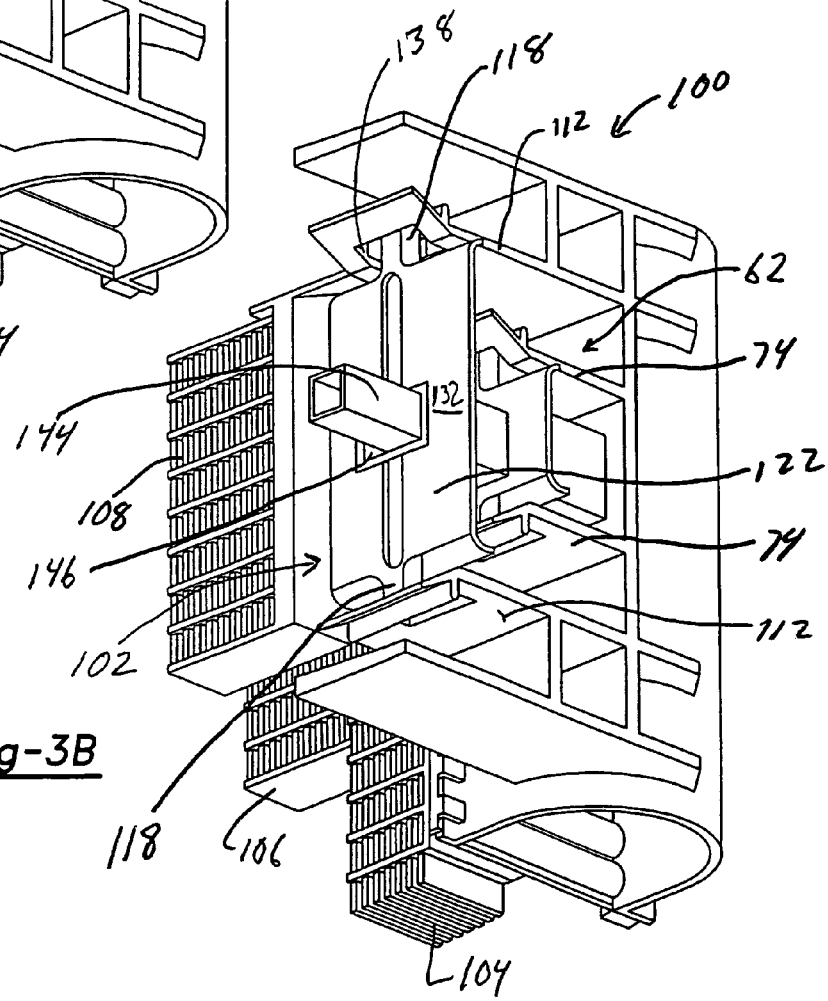
FIG. 3B is a perspective view of the heat exchanger assembly of FIG. 3A with the attachment in an attached condition.
Figure 4A:
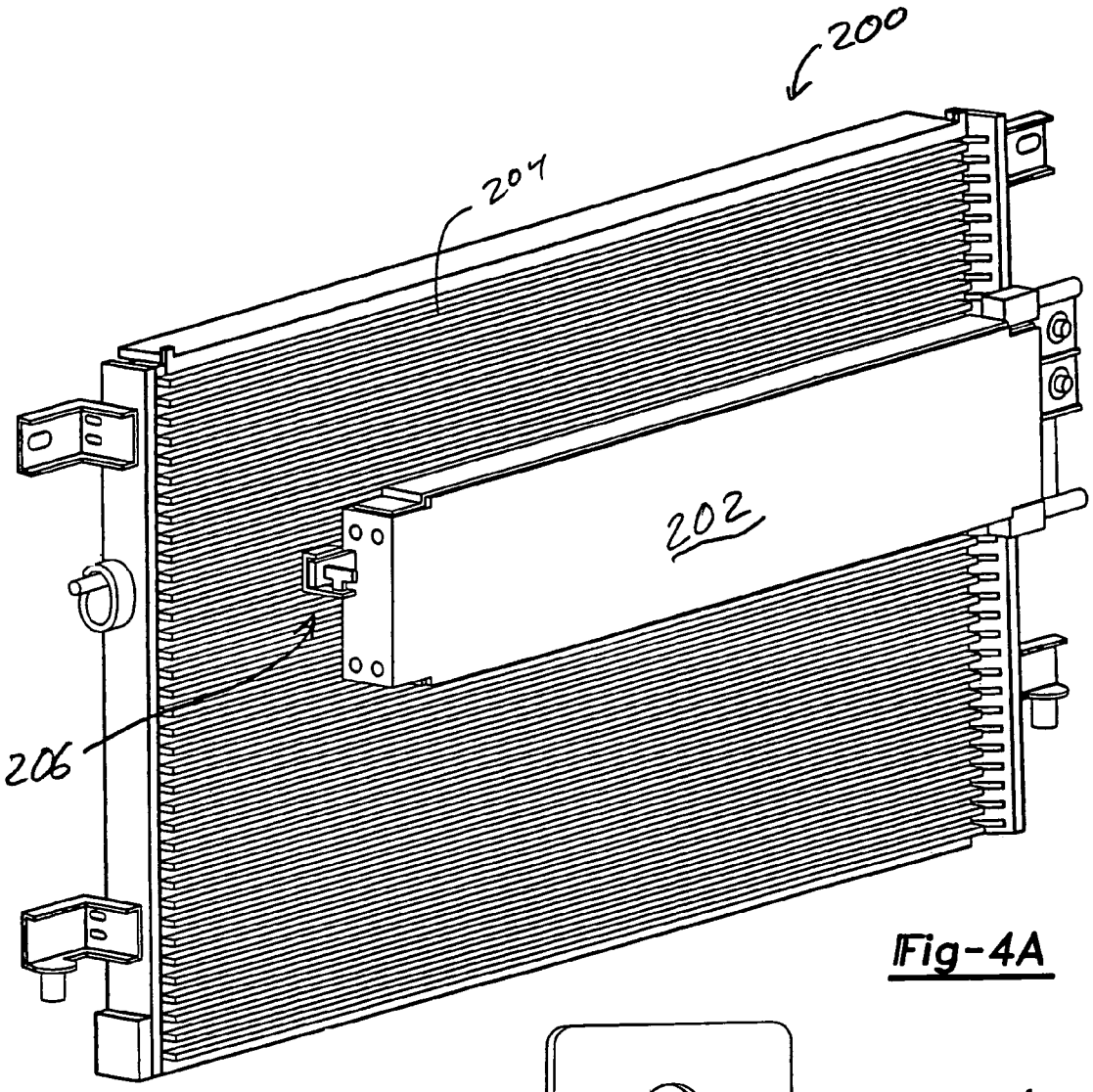
FIG. 4A is a perspective view of a heat exchanger assembly employing another attachment in accordance with an exemplary aspect of the present invention.
Figure 4B:
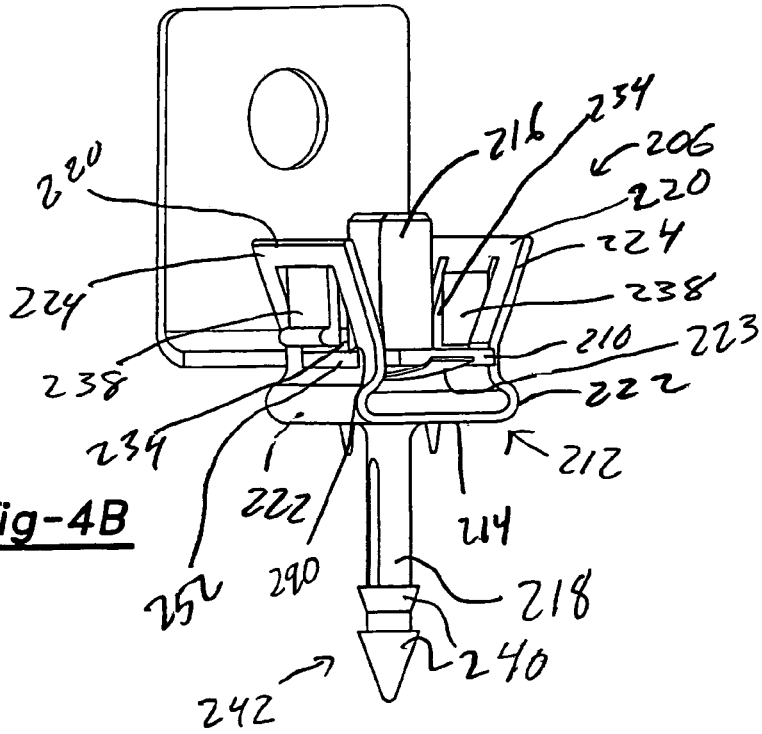
FIG. 4B is a perspective view of the attachment of FIG. 4A separate from the heat exchanger assembly.
Figure 4C:
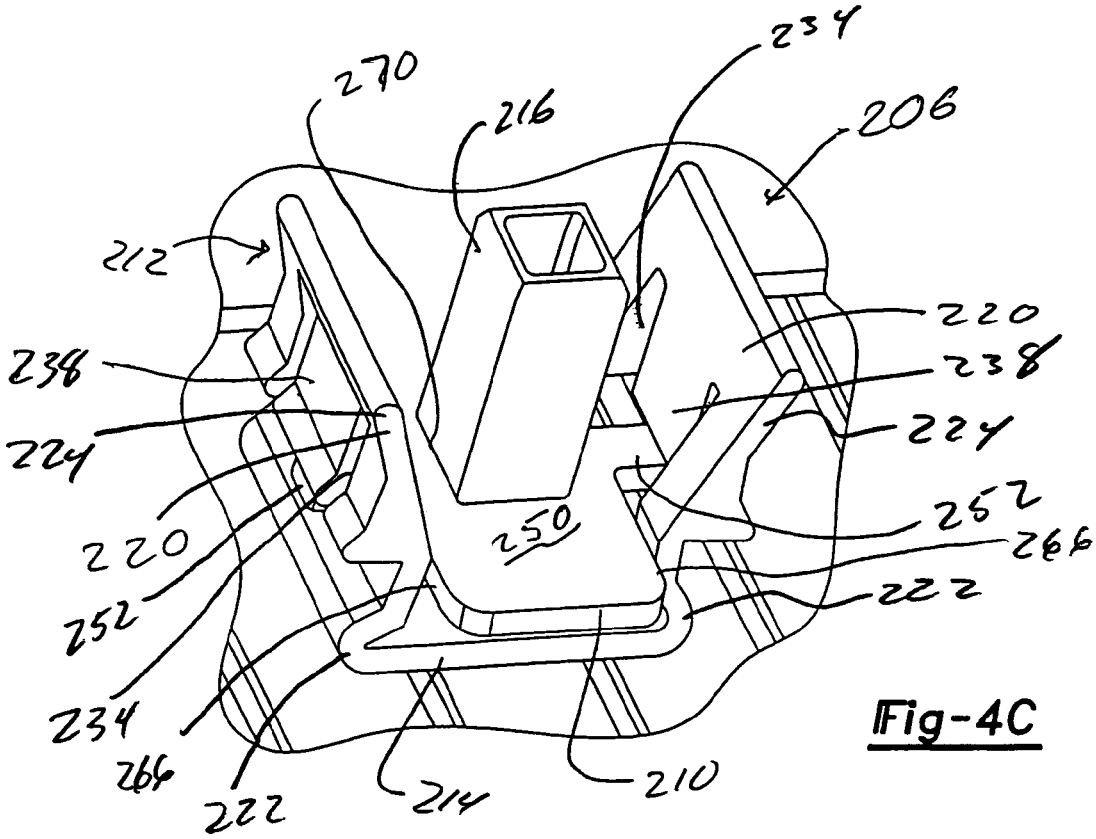
FIG. 4C is a perspective view of a portion of the heat exchanger assembly of FIG. 4A focusing on the attachment.
Figure 4D:
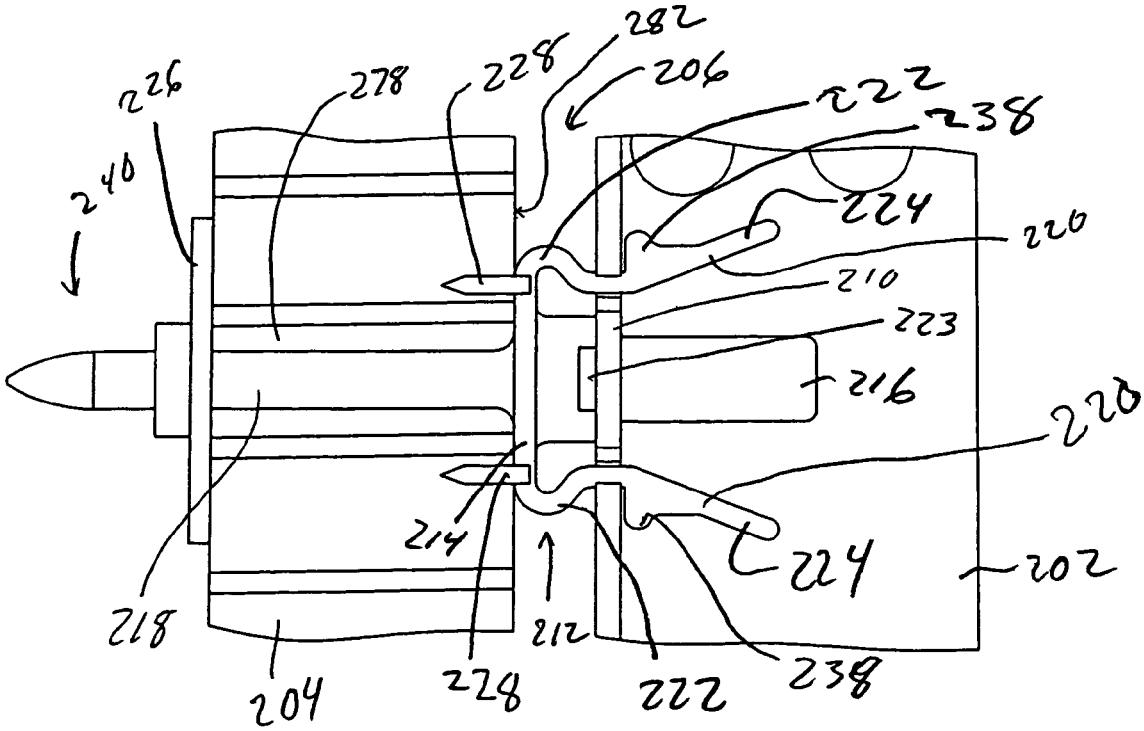
FIG. 4D is a partial cut-away side view of a portion of the heat exchanger assembly of FIG. 4A focusing on the attachment.
Figure 4E:
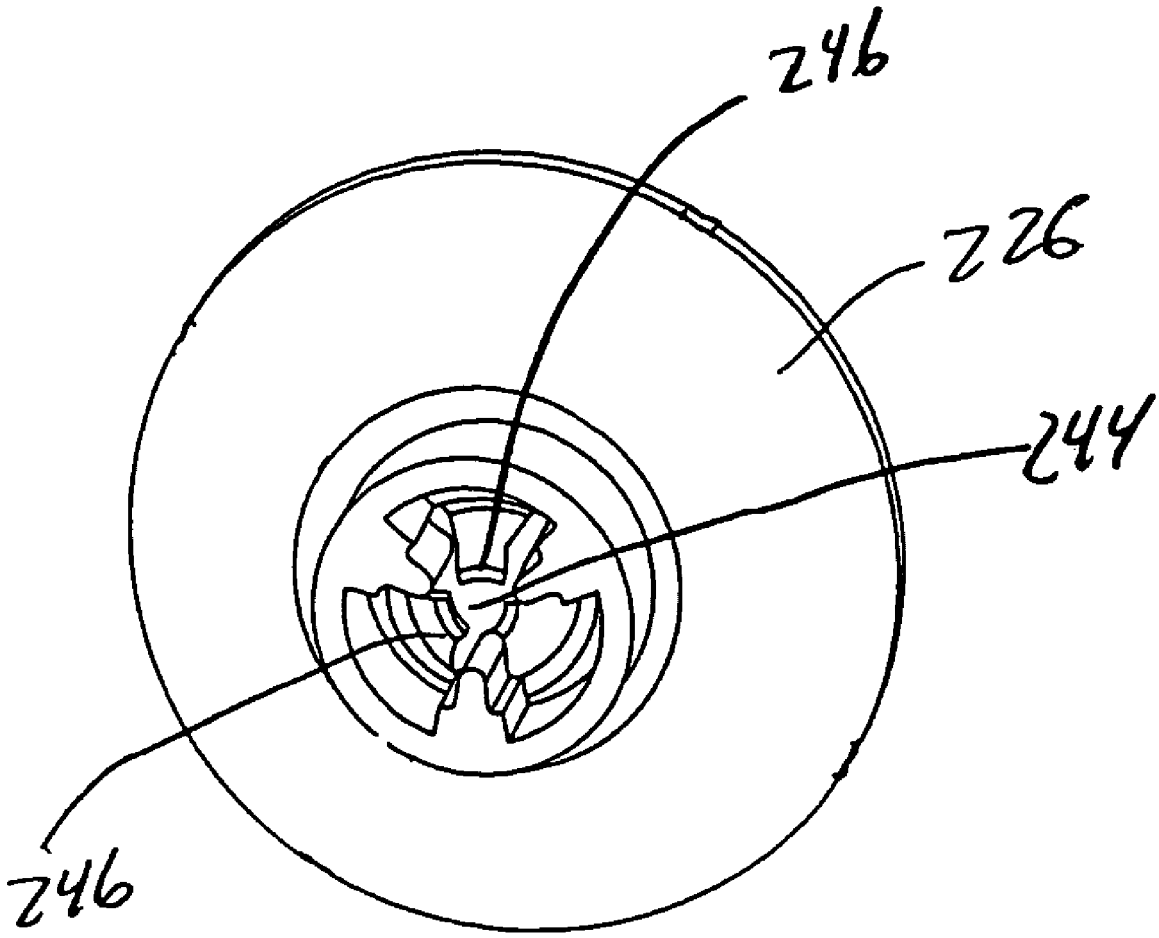
FIG. 4E is a perspective view of a portion of the attachment of FIG. 4A.

Referring to FIGS. 3A and 3B, there is illustrated another heat exchanger assembly 100 with an attachment 102 for attaching heat exchangers 104, 106. The attachment 102 substantially includes the attachment 62 shown in FIGS. 2A and 2B but has added components to adapt the attachment for attaching a third heat exchanger 108.

For providing such attachment, a second pair of flexible flange members 112 extends from the first heat exchanger 104 for receiving flanges 118 of a second flanged portion 122. As shown, the additional flange members 112 are substantially identical to the original flange members 74 with the exception that they extend further than the original flange members 74 and the additional flange members 112 are spaced further apart. To span the extra space, the second flanged portion 122 extending from the third heat exchanger 108 has been provided with a broadened central portion 132.

Upon attachment, the flanges 118 of the broadened central portion 132 are received in openings 138 of the flange members 112 in a manner substantially identical to the attachment 62 of FIGS. 2A and 2B. Additionally, an extended protrusion 144 extends from the first heat exchanger 104 and, upon attachment, is received in an opening 146 of the second flange portion 126 again, in a manner substantially identical to the attachment 62 of FIGS. 2A and 2B.

As suggested earlier, attachments according to the present invention may be provided partially or entirely separate from the components, which the attachments are employed to connect. In such embodiments, at least a portion of the attachments are attached to the components and the components are attached to each other using the attachments.

Referring to FIGS. 4A-4E, there is illustrated an alternative exemplary heat exchanger assembly 200 having a first heat exchanger 202 attached to a second heat exchanger 204 using at least one attachment 206 according to an exemplary aspect the present invention. The attachment 206 includes a flanged portion 210 and a first structure 212. Preferably, the first structure 212 includes a base 214, a protrusion 216, an extension 218, and one or more flange members 220. Optionally, the attachment 206 may also include one or more biasing members 223, a connector 226 and one or more stays 228.

The base 214 is illustrated as rectangular, but may configured in a variety of shapes, sizes and configurations. The one or more flexible flange members 220 preferably include at least two flange members 220, but may include only one. The flange members 220 may also be formed in a variety of shapes, sizes and configuration. In FIGS. 4A-4E, the flange members 220 are rectangular and each includes an opening 234 (e.g., a through-hole), which preferably extends through its respective member 220.

As shown, the flange members 220 are separate and spaced apart from each other and are in opposing relation to each other. Also, the flange members 220 extend from opposite sides of the base 214, however, it is contemplated that the flange members 220 may extend from a variety of locations on the structure 200. In the embodiment illustrated, the flanged members 220 each include a first portion 222 that extends slightly toward the other flanged member 220 and a second flared portion 224 that extends away from the other flanged member 220. Each of the flange members 220 also includes a finger 238 (which may or may not be flexible) that is cantilevered and/or extended over or adjacent the opening 234.

The protrusion 216 may be shaped or configured as desired. In FIGS. 4A-4E, the protrusion 216 is non-cylindrical (e.g., rectangular or square) and extends outwardly from a surface of a central portion of the base 224 and extends between the flange members 220.

The extension 218 may also be shaped or configured as desired. In the illustrated embodiment, the extension 218 is provided as a cylindrical rod extending from the central portion of the base 224. As shown, the extension 218 extends in a direction opposite the protrusion 216 and extends from a surface of the base 214 opposite the surface from which the protrusion 216 extends. Additionally, the extension 218 includes one or more teeth 240 at a distal end 242 of the extension 218

The connector 226 is shown as a panel (e.g., a disc-shaped panel). It is contemplated, however, that the connector may be provided in a variety of shapes, sizes and configuration. The connector 226 preferably includes an opening 244 (e.g., a through-hole) that preferably extends through the connector 226. In the particular embodiment shown, the connector 226 includes one or a plurality of flaps 246 extending into and/or overlapping portions of the opening 244.

The flanged portion 210 is preferably attached to and extends from the first heat exchanger 202. The flanged portion 210 preferably includes a central portion 250 and at least one flange 252 extending outwardly from the central portion 254. It is contemplated that the flanged portion and it flanges may be configured to have a variety of shapes and sizes. In the embodiment shown, the central portion 250 is rectangular with a pair of flanges 252 extending outward from opposite sides 266 of the central portion 250. The flanged portion 210 also optionally includes an opening 270, which is preferably located in the central portion 250.

The structure 212 and the connector 226 may be formed of a variety of materials such as polymers, metal or other materials. In a preferred embodiment, both the structure 212 and the connector 226 are formed (e.g., molded) of plastic. The flanged portion 210 may also be formed of several materials including plastics, metals or the like depending upon desired characteristics. Preferably, however, the flanged portion 210 is either integrally formed (e.g., cast, molded or otherwise shape) of metal with the second heat exchanger 204 or provided as part of a bracket, which may be attached to the second heat exchanger 204. Exemplary metals include steel, iron, aluminum, copper, brass, magnesium or a combination thereof.

For attaching the heat exchangers 202, 204 to each other, the structure 212 is attached to the second heat exchanger 204 and the flanged portion 210 is attached to the structure 210. It is contemplated that these attachment steps may be accomplished in any order or simultaneously.

In the embodiment illustrated, the structure 212 is attached to the second heat exchanger 204 by extending the extension 218 through an opening 278 (e.g., a through-hole) in the second heat exchanger 204 such that the base 214 of the structure 212 abuts surface 282 (e.g., a wall) of the heat exchanger 204. The extension 218 is also extended through the opening 244 of the connector 226 such that one or more of the teeth 240 interferingly engage the connector 226 (e.g., the flaps 246 of the connector) thereby interference fitting the structure 212 to the second heat exchanger 204.

As an added option, the stays 228 extend into openings in the second heat exchanger 204 for resisting any tendency of the structure 212 to rotate. In the embodiment shown, the stays 228 extend from that same surface of the base 214 as the extension 218 extends. However, it is contemplated that the stays may extend from other portions of the structure 212 such as from the extension 218. It is also contemplated that the extension 218 may be formed as a non-cylindrical shape (e.g., as a square or rectangle) for resisting rotation.

As illustrated, the extension 218, the connector 226, and optionally the stays 228 illustrate one preferred manner of attaching the structure 212 to the second heat exchanger 204. It is contemplated, however, that other fasteners such as nut and bolt assemblies, clips, male/female fasteners or the like may be employed as well.

In the embodiment illustrated, the flanged portion 210 is attached to the structure 218 by extending the flanges 252 of the flanged portion 210 through the openings 234 of the flange members 220 thereby interference fitting the flanges 252 with the flange members 220 of the structure 212. The flanges 252 are preferably received in the openings 234 by temporarily flexing or bending the flange members 220 away from an original position (e.g., away from each other). At the same time or thereafter, the flanges 252 are moved relative to the flange members 220 (e.g., by moving the flanged portion 210 to a location between the flange members 220) such that the flange members 220, upon return to or toward their original position, receive the flanges 252 within their openings 234. Preferably, when provided, the protrusion 216 is received in the opening 270 of the flanged portion 210 as the first heat exchanger 202 is affixed to the second heat exchanger 204.

Advantageously, during attachment, the flanges 252 may be pressed against the flared portions 224 of the flange members 220 for assisting in flexing the flange members 220, the fingers 238 or both outwardly away from their original position and/or each other. In turn, the flanges 252 may be more easily received in the openings 234 of the flange members 220. Also advantageous, the finger 238 (e.g., an edge of the finger) of each flange member 220 abuts a back side 290 of each flange 252 for assisting in securing the flanged portion 210 to the flexible flange members 220.

In the embodiment of FIGS. 4A-4E, the flanged portion 250 may be secured relative to the flange members 220 to limit or substantially restrict relative motion therebetween in one, two or three dimensions. In the embodiment shown, the protrusion 216 is received within the opening 270 of the flanged portion 250 within tight tolerances (e.g., less than one or two millimeters) along a first and second axes (e.g., a vertical axis and a horizontal axis) wherein the first and second axes are skew or perpendicular to each other. In this manner, movement is substantially entirely prohibited in directions along the first and second axes. Additionally, the flanges 252 are preferably secured within the openings 234 of the flange members 220 such that the flanges 252 and the base 214 maintain the flanged portion 250 within tight tolerances along a third axis (e.g., another horizontal axis) wherein the third axis is skew or substantially perpendicular to both the first and second axes. Optionally, upon attachment of the flange portion 210 to the structure 212, the biasing member 223 is preferably pressed against the flanged portion 220 to assist in minimizing movement between the flanged portion 220 and the structure 212 particularly along the third axis. In this manner, movement is substantially entirely prohibited in directions along the third axis. Thus, once attached, movement of the flanged portion 210 relative to the flange members 220 is substantially entirely restricted in three dimensions. It should be understood that various biasing members such as biasing member 223 may be employed with any of the embodiments herein to minimized undesired movements.

Of course, it is contemplated that attachments according to the present invention may allow motion as well as restrict motion. Moreover, various larger or smaller tolerances may be formed between openings, flanges, flanged portions, flange members, protrusions or any other components to restrict or allow motion as desired.

Also advantageous, however, the flanges 252 may be manually or mechanically released by outwardly flexing the flange members 220 particularly if one of the heat exchangers 202, 204 or other components need servicing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger assembly, comprising:

a first component;

a flanged portion attached to the first component, the flanged portion having a central portion with an opening formed therein and a pair of flanges extending outward from opposite sides of the central portion;

a second component, wherein at least one of the first component and second component is a heat exchanger;

a structure attached to the second component wherein the structure includes i) a base;

ii) a pair of flange members extending from the base, the flange members substantially opposing each other and each of the flange members including an opening and a flexible finger cantilevered over the opening;

iii) a protrusion extending from the base, the protrusion located between the pair of flange members;

iv) an extension extending into an opening of the second component for attaching the structure to the second component;

wherein the protrusion is received in the opening of the flanged portion, the pair of flanges are received in the openings of the flexible flange members and the flexible finger of each flange member respectively abuts a flange of flanged portion for assisting in attaching the first component to the second component.

2. A heat exchanger assembly as in claim 1 wherein each of the flange members includes a flared portion for assisting in biasing the flange members away from an original position such that the flanges may be received in the openings of the flange members.

3. A heat exchanger assembly as in claim 2 wherein each of the flanges includes a contoured surface for additionally assisting in biasing the flange members away from an original position such that the flanges may be received in the openings of the flange members.

4. A heat exchanger assembly as in claim 1 wherein the protrusion is received within tight tolerances of the opening of the flanged portion for resisting movement along at least a first axis.

5. A heat exchanger assembly as in claim 4, wherein the tight tolerances resist movement along a second axis skew to the first axis and the flanges are receive within tight tolerances of the opening of the flange members for resisting movement along a third axis that is skew to the first and second axes.

6. A heat exchanger assembly as in claim 1 wherein the protrusion is non-cylindrical for limiting any relative rotation between the flanged portion and the protrusion.

7. A heat exchanger assembly as in claim 1 further comprising at least one stay extending into the second component for resisting rotation of the structures.

8. A heat exchanger assembly as in claim 1 further comprising a connector attached to the extension of the structure for assisting in attaching the structure to the second components.

9. A heat exchanger assembly as in claim 1 wherein the structure is formed of plastic.

* * * * *